US009531104B1

(12) United States Patent
Park et al.

(10) Patent No.: US 9,531,104 B1
(45) Date of Patent: Dec. 27, 2016

(54) JOINT CONNECTOR

(71) Applicant: HYUNDAI MOTOR COMPANY, Seoul (KR)

(72) Inventors: Se Hoon Park, Yongin-si (KR); Jin Sung Sa, Yongin-si (KR); Hyun Chung Ko, Anyang-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/929,142

(22) Filed: Oct. 30, 2015

(30) Foreign Application Priority Data

Jun. 26, 2015 (KR) ..... 10-2015-0090976

(51) Int. Cl.
*H01R 31/08* (2006.01)
*H01R 13/436* (2006.01)

(52) U.S. Cl.
CPC ..... *H01R 13/4361* (2013.01)

(58) Field of Classification Search
CPC ..... H01R 29/00; H01R 31/08; H01R 13/4362
USPC ..... 439/189, 507, 511, 752
See application file for complete search history.

(56) References Cited

U.S. PATENT DOCUMENTS 4,952,155 A * 8/1990 Kuzuno ..... H01R 31/08 439/189
5,106,318 A * 4/1992 Endo ..... H01R 31/08 439/189
5,356,302 A * 10/1994 Inoue ..... H01R 31/085 439/189
5,569,054 A * 10/1996 Yagi ..... H01R 13/4361 439/595
5,769,650 A * 6/1998 Aoyama ..... H01R 13/4365 439/189
5,971,801 A * 10/1999 Kato ..... B60L 3/0069 439/157
6,056,569 A * 5/2000 Nakamura ..... H01R 13/506 439/189
6,261,123 B1 * 7/2001 Kruger ..... H01R 13/60 439/484

(Continued)

FOREIGN PATENT DOCUMENTS

JP 07-326414 A 12/1995
JP 8-250247 A 9/1996

(Continued)

OTHER PUBLICATIONS

Korean Office Action dated Sep. 12, 2016, issued in Korean Patent Application No. 10-2015-0090976.

*Primary Examiner* — Thanh Tam Le
(74) *Attorney, Agent, or Firm* — McDermott Will & Emery LLP

(57) ABSTRACT

A joint connector includes a housing having a plurality of mounting passages into which a plurality of wires are horizontally inserted from the outside to the inside, and a fastening hole formed in the upper surface thereof and in communication with the mounting passages of the housing, a terminal inserted into the mounting passages of the housing and having a plurality of connection parts connected to an external circuit through the plurality of wires, and a holder vertically inserted into the fastening hole of the housing and having a plurality of fastening protrusions formed on a bottom surface thereof to fasten the terminal to the housing.

9 Claims, 7 Drawing Sheets

(56) References Cited

U.S. PATENT DOCUMENTS

| | | | | |
|---|---|---|---|---|
| 6,368,128 | B1 * | 4/2002 | Backer | H01R 31/08 439/189 |
| 7,351,085 | B2 * | 4/2008 | Tamagawa | H01R 12/592 439/189 |
| 7,878,869 | B2 * | 2/2011 | Murano | H01R 13/4361 439/792 |
| 7,883,361 | B2 * | 2/2011 | Ambo | H01R 31/08 439/507 |
| 7,883,362 | B2 * | 2/2011 | Ichio | H01R 13/40 439/511 |
| 2014/0134869 | A1 | 5/2014 | Hamai et al. | |

FOREIGN PATENT DOCUMENTS

| | | | |
|---|---|---|---|
| JP | 11-214101 | A | 8/1999 |
| JP | 2006-100183 | A | 4/2006 |
| JP | 2007-220590 | A | 8/2007 |
| KR | 10-2009-0073878 | A | 7/2009 |
| KR | 10-2009-0111702 | A | 10/2009 |
| KR | 10-2012-0002160 | A | 1/2012 |
| KR | 10-2014-0036035 | A | 3/2014 |

* cited by examiner

JOINT CONNECTOR

CROSS-REFERENCE TO RELATED APPLICATION

This application claims the benefit of priority to Korean Patent Application No. 10-2015-0090976, filed on Jun. 26, 2015 with the Korean Intellectual Property Office, the disclosure of which is incorporated herein in its entirety by reference.

TECHNICAL FIELD

The present disclosure relates to a joint connector, and more particularly, to a joint connector capable of reducing the number of parts of the connector and reducing a size, cost and weight of the connector.

BACKGROUND

In general, a connector includes a connector housing and a terminal, and is widely used for a power supply circuit, of a washing machine, a refrigerator, a vehicle, or the like.

In a case in which the connector is used for the above-mentioned electronic apparatuses, since a plurality of parts are separately assembled and are then inserted into a finished product, maintenance work and work for manufacturing the apparatuses may be significantly simplified.

The above-mentioned connector is coupled to a mating connector, such that terminals each provided between two connectors are electrically connected to each other.

In this case, the connector may include a plurality of terminals. In addition, the mating connector includes a bus bar type of terminal for connecting between the plurality of terminals. The above-mentioned connector is generally called a joint connector.

However, the joint connector according to the related art has a basic structure in which a female housing and a male housing are coupled to each other, a holder is added to this structure, and a joint bus bar connected to a terminal including a wire is inserted into this structure. Therefore, since the joint connector has a large number of parts, an assembly process may be increased, thereby increasing size, cost, and weight of the joint connector.

RELATED ART DOCUMENT

Patent Document 1: Korean Patent Laid-Open Publication No. 10-2012-0002160

SUMMARY

The present disclosure has been made to solve the above-mentioned problems occurring in the prior art while advantages achieved by the prior art are maintained intact.

An aspect of the present disclosure provides a joint connector, and more particularly, a joint connector capable of reducing the number of parts of the connector and reducing a size, costs, and weight of the connector.

According to an exemplary embodiment of the present disclosure, a joint connector includes a housing having a plurality of mounting passages into which a plurality of wires are horizontally inserted from the outside to the inside, and a fastening hole formed in the upper surface thereof and in communication with the mounting passages of the housing; a terminal inserted into the mounting passages of the housing and having a plurality of connection parts connected to an external circuit through the plurality of wires; and a holder vertically inserted into the fastening hole of the housing and having a plurality of fastening protrusions formed on a bottom surface thereof to fasten the terminal to the housing.

Insertion holes, that may be connected to the wires and allow the fastening protrusions of the holder to be inserted thereinto, may be formed in the connection parts of the terminal.

Circuit patterns may be formed on the fastening protrusions of the holder so that the fastening protrusions are connected to the wires when the fastening protrusions are inserted into the insertion holes of the terminal.

A pressing part formed of an elastic body may be formed inside the fastening hole to fix and compress the fastening protrusions when the fastening protrusions are inserted into the fastening hole.

Locking protrusions fixing the holder to the housing may be formed at both ends of the holder.

The circuit patterns may form intaglio patterns of a groove shape in the fastening protrusions and the intaglio patterns may be plated with copper, nickel and gold.

Eight fastening protrusions may be formed and the circuit patterns may be formed on the respective fastening protrusions, such that the eight fastening protrusions may be formed as one set, or four fastening protrusions and four fastening protrusions may be formed as one set each, or three fastening protrusions and five fastening protrusions may be formed as one set each.

According to another exemplary embodiment of the present disclosure, a joint connector may include a housing having a plurality of mounting passages into which a plurality of wires are horizontally inserted from the outside to the inside and a fastening hole formed in the upper surface thereof and in communication with the mounting passages of the housing; a terminal inserted into the mounting passages of the housing and having a plurality of connection parts including insertion holes to be connected to an external circuit through the plurality of wires; and a holder vertically inserted into the fastening hole of the housing and having a plurality of fastening protrusions formed on a bottom surface thereof to fasten the terminal to the housing, wherein circuit patterns are formed on the fastening protrusions of the holder so that the fastening protrusions are connected to the wires when the fastening protrusions are inserted into the insertion holes of the terminal.

The insertion holes may be formed in the connection parts of the terminal to be connected to the wires and allow the fastening protrusions of the holder to be inserted thereinto to connect the wires and the circuit patterns formed on the fastening protrusions to each other.

According to another exemplary embodiment of the present disclosure, a joint connector including a plurality of terminals connected to a circuit and branching or integrating the circuit may include: a housing having mounting passages into which the plurality of terminals are inserted and a fastening hole exposing the plurality of terminals inserted into the mounting passages to the outside; and a holder inserted into the fastening hole to fix the plurality of terminals to the housing and having circuit patterns electrically connecting the plurality of terminals to the holder.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
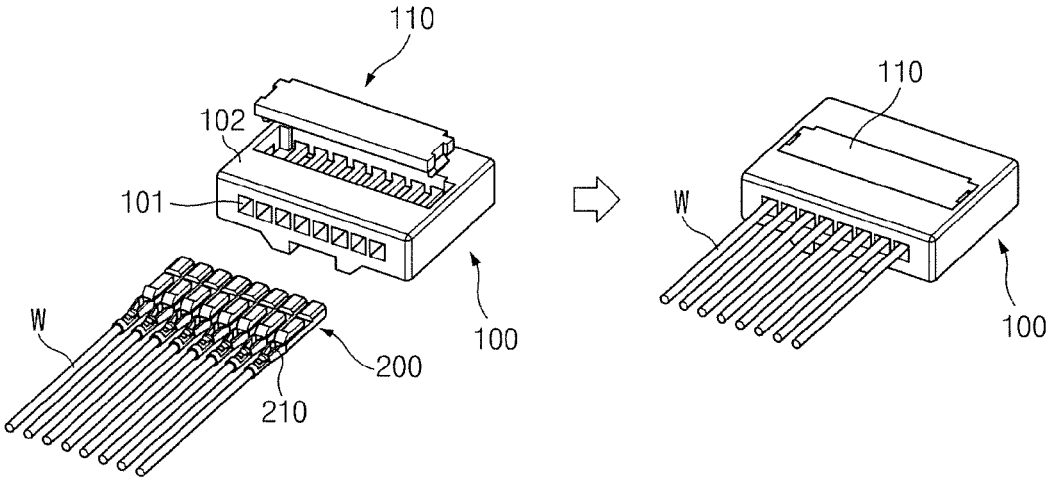
FIG. 1 is a diagram illustrating states before and after a joint connector, according to the present disclosure, is assembled.

Exemplary embodiments of the present disclosure will be described in detail with reference to the accompanying drawings.

A joint connector according to the present disclosure may include a housing 100 in which mounting passages 101 and a fastening hole 102 are formed, a terminal 200 inserted into the mounting passages 101 of the housing 100 and connected to wires W, and a holder 110 inserted into the fastening hole 102 of the housing 100 and fastening the terminal 200 to the housing 100, as illustrated in FIGS. 1 to 4.

As illustrated in FIG. 1, the housing 100 may be formed in a general connector case shape, wherein a plurality of mounting passages 101 into which the wires W may be horizontally inserted from the outside to the inside are formed in one surface of the housing 100, and the fastening hole 102 which is in communication with the mounting passages 101 may be formed in an upper surface of the housing 100.

The terminal 200 may be inserted into the mounting passages 101 of the housing 100 and may have a plurality of connection parts 210 formed to be connected to an external circuit through the plurality of wires W.

Figure 2:
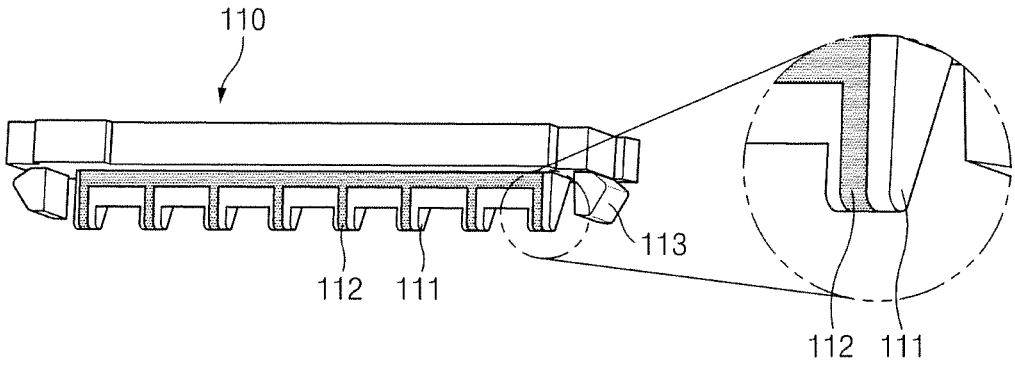
FIG. 2 is a diagram illustrating a holder of the joint connector according to the present disclosure.

As illustrated in FIGS. 1 and 2, the holder 110, which is a component for fixing the terminal 200 to the housing 100, may be vertically inserted into the fastening hole of the housing 100 and has a plurality of fastening protrusions 111 formed on a bottom surface thereof to compress the terminal 200 in a state in which the holder 110 is inserted into the fastening hole 102, and to fasten and fix the terminal 200 to the housing 100.

In this case, insertion holes are formed in the connection parts 210 of the terminal 200. Thereby, the wires W may be connected to side surfaces of the insertion holes to be connected to a circuit, and the fastening protrusions ill of the holder 110 may be inserted into upper surfaces of the insertion holes to fix the holder 110.

Figure 3:
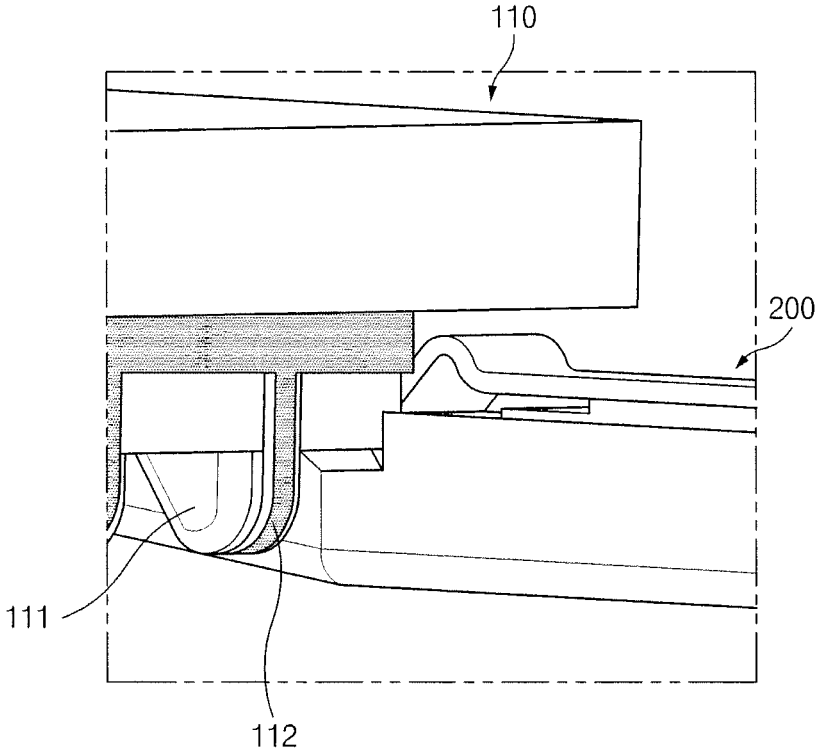
FIG. 3 is a diagram illustrating a state in which a terminal and the holder are coupled to each other in the joint connector according to the present disclosure.

As illustrated in FIGS. 2 and 3, circuit patterns 112 having a printed circuit board (PCB) structure may be formed on the fastening protrusions 111 of the holder 110 so that the fastening protrusions 111 are connected to the wires W when the fastening protrusions 111 are inserted into the insertion holes of the terminal 200.

The circuit patterns 112 may form intaglio patterns of a groove shape in the fastening protrusions 111 and the intaglio patterns may be plated with copper, nickel, and gold, thereby making it possible to electrically connect the holder 110 and the terminal 200 to each other.

Figure 5A:
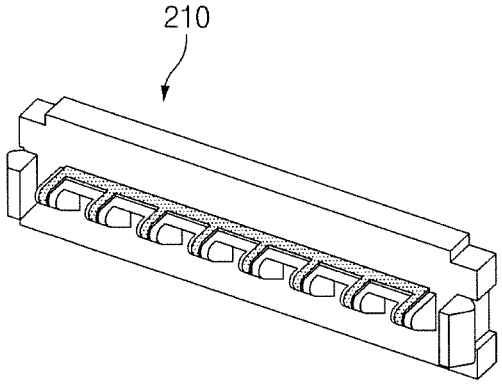
FIG. 5 A is a diagram illustrating a first example of the holder and FIG. 5 B is a circuit pattern in the joint connector according to the present disclosure.
Figure 5B:
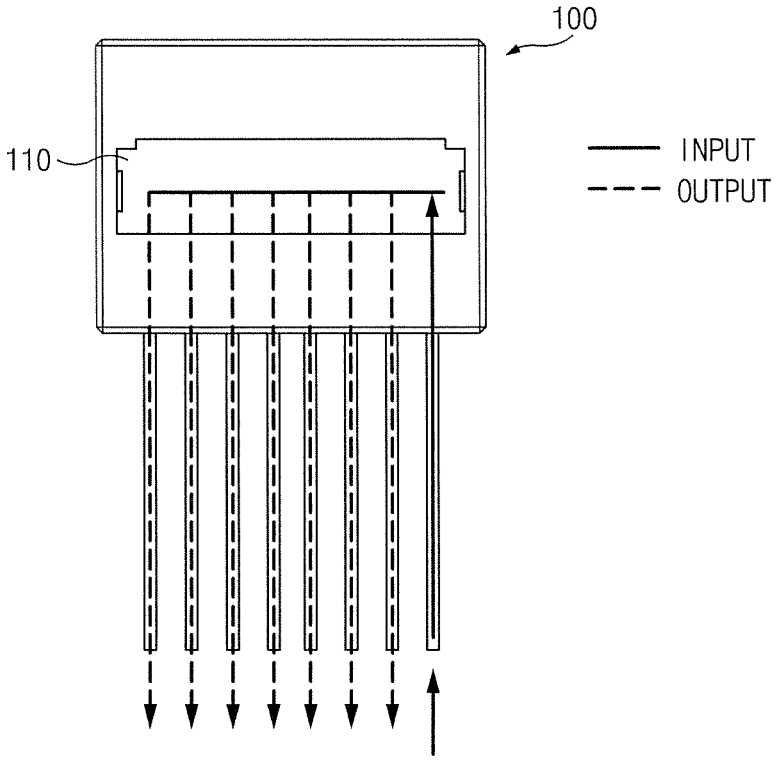
Figure 6A:
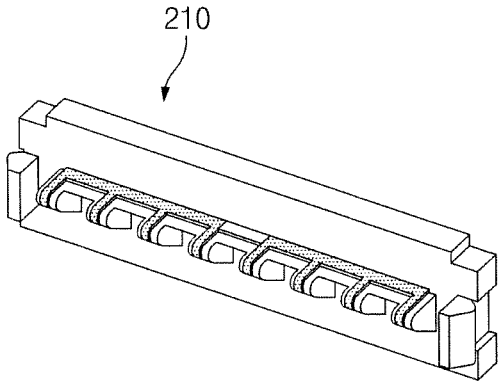
FIG. 6 A is a diagram illustrating a second example of the holder and FIG. 6 B is a circuit pattern in the joint connector according to the present disclosure.
Figure 6B:
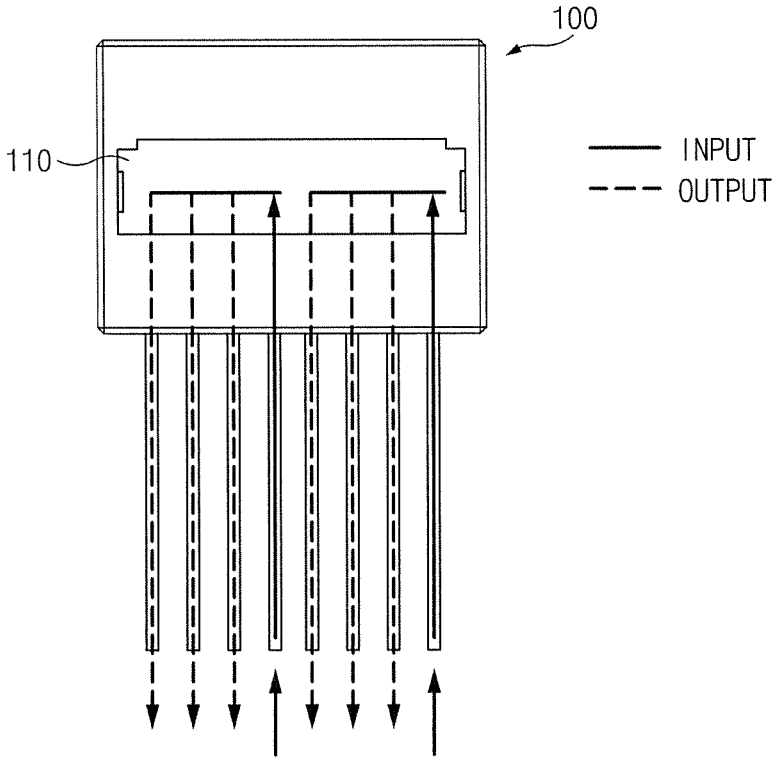
Figure 7A:
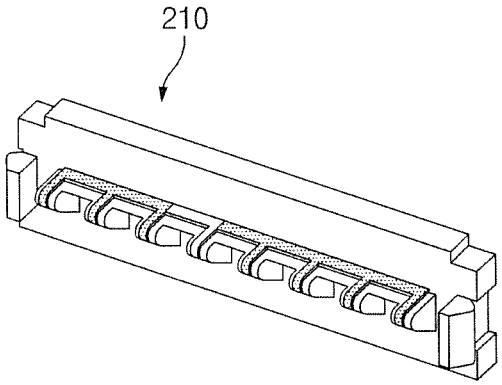
FIG. 7 A is a diagram illustrating a third example of the holder and FIG. 7 B is a circuit pattern in the joint connector according to the present disclosure.
Figure 7B:
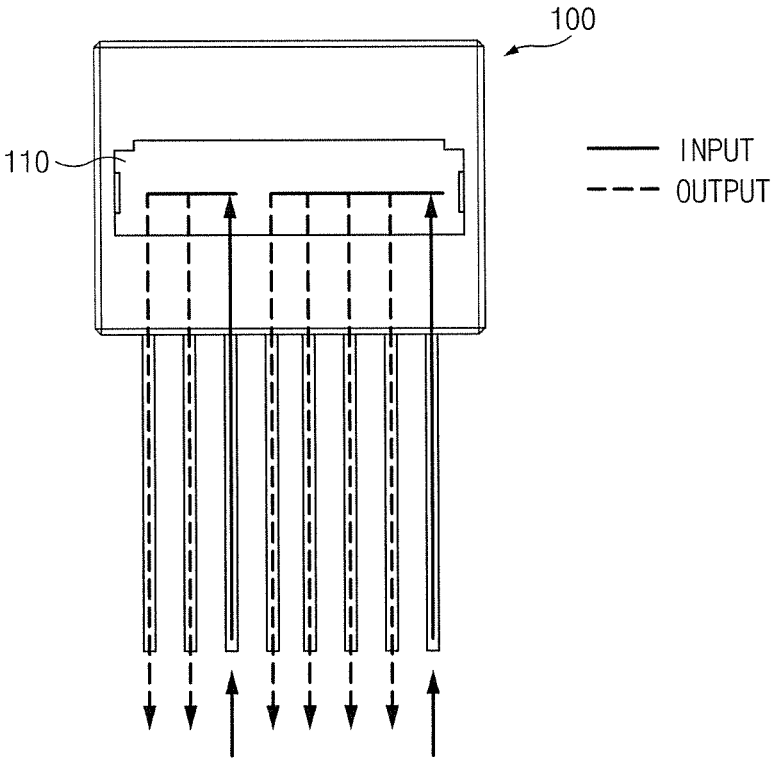

As illustrated in FIG. 5, eight fastening protrusions 111 may be formed as one set by forming the eight fastening protrusions 111 on the holder 110 and forming the circuit patterns 112 on the respective fastening protrusions 111. However, it may be preferable to form four fastening protrusions 111 and four fastening protrusions 111 as one set each as illustrated in FIG. 6, and form three fastening protrusions 111 and five fastening protrusions 111 as one set each as illustrated in FIG. 6.

Figure 4:
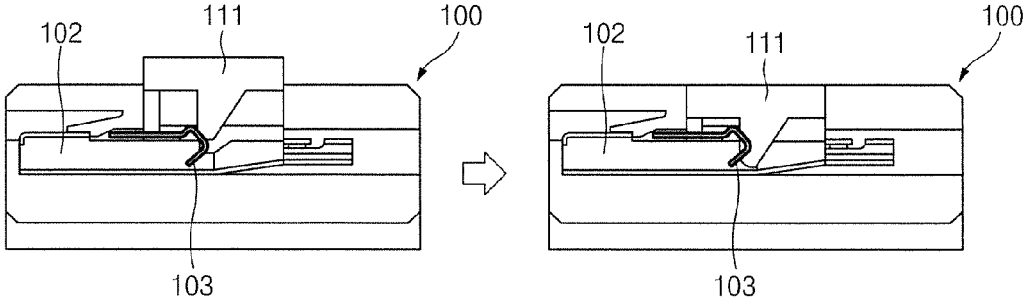
FIG. 4 is a diagram illustrating a state of a pressing part at the time of a holder coupling in the joint connector according to the present disclosure.

As illustrated in FIG. 4, the pressing part 103 formed of an elastic body is formed inside the fastening hole 102 of the housing, such that the elastic body compresses the fastening protrusions 111 when the fastening protrusions are inserted into the fastening hole 102, thereby improving a fixing force of the housing and the holder 110.

Locking protrusions 113 may be formed at both ends of the holder 110 to fix the holder 110 to the housing 100 when the holder 110 is inserted into the fastening hole 102, thereby preventing the holder 110 from separating from the housing 100.

As such, the joint connector according to the present disclosure may include the housing 100 configured to have a plurality of mounting passages 101 into which a plurality of wires W may be horizontally inserted from the outside to the inside and the fastening hole 102 formed in the upper surface thereof and in communication with the mounting passages 101 of the housing 100, the terminal 200 configured to have the plurality of connection parts 210 formed to be inserted into the mounting passages 101 of the housing 100 and connected to the external circuit through the plurality of wires W, and the holder 110 configured to be vertically inserted into the fastening hole 102 of the housing 100 and have the plurality of fastening protrusions 111 formed on the bottom surface thereof to fasten the terminal 200 to the housing.

As described above, according to the exemplary embodiment of the present disclosure, a function of a general connector and a function of the joint connector may be simultaneously satisfied, whereby the parts such as the male connector and the joint bus bar may be omitted, such that the size, cost, and weight of the joint connector may be reduced and a working process time may be reduced. In addition, the pattern may be easily changed without modification or change of a mold or the parts by using a PCB technology.

As described above, although the present disclosure has been described with reference to exemplary embodiments and the accompanying drawings, it would be appreciated by those skilled in the art that the present disclosure is not limited thereto but various modifications and alterations might be made without departing from the scope defined in the following claims.

What is claimed is:

1. A joint connector comprising:

a housing having a plurality of mounting passages into which a plurality of wires are horizontally inserted from the outside to the inside, and a fastening hole formed in the upper surface thereof and in communication with the mounting passages of the housing;

a terminal inserted into the mounting passages of the housing and having a plurality of connection parts connected to an external circuit through the plurality of wires; and a holder vertically inserted into the fastening hole of the housing and having a plurality of fastening protrusions formed on a bottom surface thereof to fasten the terminal to the housing, wherein circuit patterns are formed on the fastening protrusions of the holder, and wherein the circuit patterns form intaglio patterns of a groove shape in the fastening protrusions.

2. The joint connector according to claim 1, wherein insertion holes connected to the wires, allowing the fastening protrusions of the holder to be inserted thereinto, are formed in the connection parts of the terminal.

3. The joint connector according to claim 2, wherein the fastening protrusions are connected to the wires when the fastening protrusions are inserted into the insertion holes of the terminal.

4. The joint connector according to claim 3, wherein a pressing part formed of an elastic body is formed inside the insertion hole to fix and compress the fastening protrusions when the fastening protrusions are inserted into the insertion hole.

5. The joint connector according to claim 1, wherein locking protrusions fixing the holder to the housing are formed at both ends of the holder.

6. The joint connector according to claim 3, wherein eight fastening protrusions are formed and the circuit patterns are formed on the respective fastening protrusions, such that the eight fastening protrusions are formed as one set, or four fastening protrusions and four fastening protrusions are formed as one set each, or three fastening protrusions and five fastening protrusions are formed as one set each.

7. A joint connector comprising:

a housing having a plurality of mounting passages into which a plurality of wires are horizontally inserted from the outside to the inside, and a fastening hole formed in the upper surface thereof and in communication with the mounting passages of the housing;

a terminal inserted into the mounting passages of the housing and having a plurality of connection parts including insertion holes to be connected to an external circuit through the plurality of wires; and a holder vertically inserted into the fastening hole of the housing and having a plurality of fastening protrusions formed on a bottom surface thereof to fasten the terminal to the housing, wherein circuit patterns are formed on the fastening protrusions of the holder so that the fastening protrusions are connected to the wires when the fastening protrusions are inserted into insertion holes of the terminal, and wherein the circuit patterns form intaglio patterns of a groove shape in the fastening protrusions.

8. The joint connector according to claim 7, wherein the insertion holes are formed in the connection parts of the terminal to be connected to the wires, and allow the fastening protrusions of the holder to be inserted thereinto to connect the wires and the circuit patterns formed on the fastening protrusions to each other.

9. A joint connector including a plurality of terminals connected to a circuit and integrating the circuit, the joint connector comprising:

a housing having mounting passages into which the plurality of terminals are inserted and a fastening hole exposing the plurality of terminals inserted into the mounting passages to the outside; and a holder inserted into the fastening hole to fix the plurality of terminals to the housing and having circuit patterns electrically connecting the plurality of terminals to the holder, wherein the circuit patterns are formed on fastening protrusions of the holder, and wherein the circuit patterns form intaglio patterns of a groove shape in the fastening protrusions.

* * * * *